United States Patent [19]

Järvi et al.

[11] Patent Number: 5,074,813

[45] Date of Patent: Dec. 24, 1991

[54] METHOD AND ARRANGEMENT ON A VESSEL

[75] Inventors: Antti K. H. Järvi, Espoo; Juha A. Heikinheimo, Helsinki; Erkki V. E. Hirvonen, Kerava, all of Finland

[73] Assignee: Rauma-Repola Oy, Helsinki, Finland

[21] Appl. No.: 573,730

[22] Filed: Aug. 28, 1990

Related U.S. Application Data

[63] Continuation of Ser. No. 363,379, Jun. 5, 1989, Pat. No. 4,973,275, which is a continuation of Ser. No. 920,284, Oct. 17, 1986, abandoned.

[30] Foreign Application Priority Data

Oct. 25, 1985 [FI] Finland ..... 854197

[51] Int. Cl.[5] ..... B63H 1/18

[52] U.S. Cl. ..... 440/66; 114/67 A

[58] Field of Search ..... 440/66–70, 440/89; 114/67 R, 67 A; 416/90 R, 90 A, 91, 93 R, 93 A

[56] References Cited

U.S. PATENT DOCUMENTS

| | | | |
|---|---|---|---|
| 1,007,583 | 10/1911 | Loetzer | 440/69 |
| 3,575,526 | 4/1971 | Van Gunsteren | 416/90 A |
| 3,924,556 | 12/1975 | Wacker | 440/66 |
| 4,188,906 | 2/1980 | Tachmindji et al. | 440/66 |
| 4,383,829 | 5/1983 | Allen, Jr. et al. | 440/66 |

FOREIGN PATENT DOCUMENTS

| | | | |
|---|---|---|---|
| 133892 | 11/1978 | Japan | 440/66 |
| 57-092 | 4/1984 | Japan | 440/66 |
| 461861 | 4/1975 | U.S.S.R. | 114/67 A |

*Primary Examiner*—Jesus D. Sotelo

*Attorney, Agent, or Firm*—Burns, Doane, Swecker & Mathis

[57] ABSTRACT

Method and arrangement for the reduction of the resistance to rotation of the propeller (3) of a ship (1) going in ice when the ice increases the resistance to rotation of the propeller to a level higher than when sailing in open water. When the resistance to rotation increases, gas is passed to the propeller (3), and the supply of gas is adjusted when the resistance to rotation is changed. The supply of gas may be continual, but as a rule it is used only for short periods in order to correct the speed of rotation of the propeller to the appropriate level.

3 Claims, 3 Drawing Sheets

METHOD AND ARRANGEMENT ON A VESSEL

Figure 1:
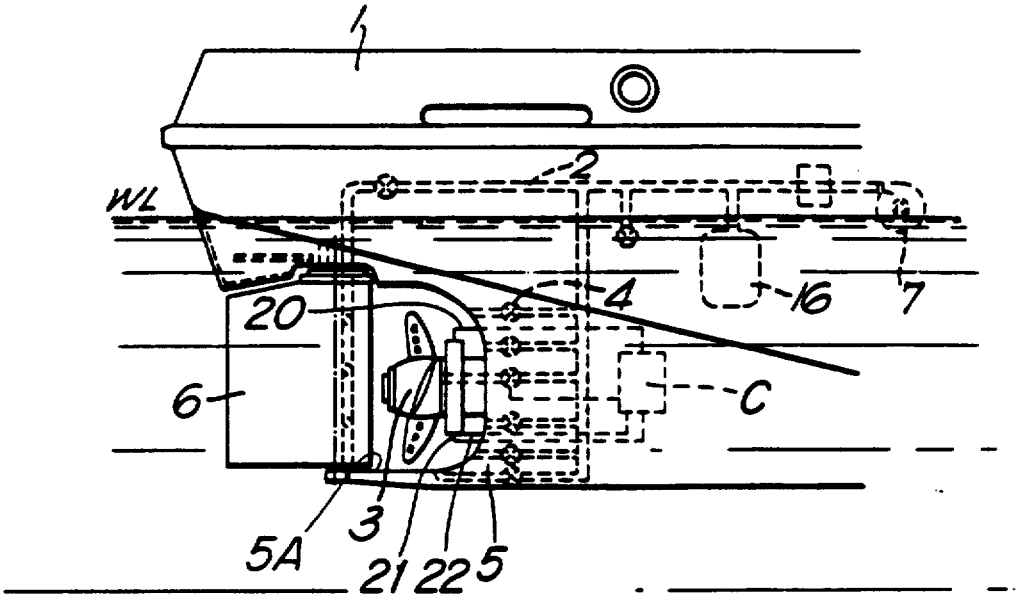

This application is a continuation of application Ser. No. 363,379, filed on June 5, 1989, now U.S. Pat. No. 4,973,275, which was a continuation of application Ser. No. 920,284 filed on Oct. 17, 1986 now abandoned.

The present invention concerns a method for the reduction of the resistance to rotation of the propeller of a vessel so that gas is fed or formed to the propeller. The invention also concerns a system for the reduction of the resistance to rotation of the propeller of a vessel so that gas is fed or formed to the propeller.

The resistance to rotation of the propeller of a ship going in ice, i.e. the torque opposite to the movement of the propeller, increases and the speed of rotation of the propeller becomes lower when the ice slows down the running speed of the ship and when pieces of ice get into the propeller. When high-power diesel engines are used, in order to obtain the maximum output out of the engine, it is, however, important that the speed of rotation of the diesel engine coupled to the propeller should not be lowered.

In prior art, it is known to use controllable-pitch propellers on vessels, whose resistance to rotation can be reduced by reducing the pitch angle of the blades of the propeller. Controllable-pitch propellers are, however, expensive, and the large size of their hub causes losses. The ice also causes problems in respect of their strength and reliability. It is particularly detrimental that, when the pitch of the propeller is reduced when running in ice, the blades become turned almost transversely to the ice coming from ahead, whereby the loads of ice against the blade increase and act in the direction in which the strength of the blade is lowest. At the same time, the gap between the blades becomes to such an extent smaller that pieces of ice can pass through the propeller between the blades only after they have been crushed to small size. This causes intensive vibrations on the ship.

Likewise, it is known in prior art to use, e.g., electric, hydraulic or mechanical power transmission systems of high cost, by means of which it is possible to vary the ratio of the speeds of rotation of the engine and of the propeller.

The object of the present invention is to reduce the propeller resistance of an ice-going vessel controllably, usually as short sequences, in order that power transmission systems of variable transmission ratio or controllable-pitch propellers should not be required for running in ice, or in order to intensify the effect of the controlling when a controllable-pitch propeller is used.

Methods are known for passing air or some other gas to the propeller of a vessel in order that drawbacks resulting from cavitation could be reduced, drawbacks such as, e.g., noise and erosion. The removal of steam bubbles produced by cavitation causes strong pressure impacts. Gas bubbles blown to the propeller are, however, not lost with an increase in pressure, but they just become smaller smoothly, whereby pressure impacts are prevented. It is also known to pass air or exhaust gas to the propeller in speedboats provided with supercavitating propellers and in other high-speed boats. The function of the gas is, besides reducing the cavitation, also to compensate for the differential water resistance of the propeller of a gliding or planing boat as compared between the planing stage and the stage at which the boat has not yet come up from the displacement stage to planing.

Ice-strengthened ships and ships constructed for ice-dues classification are, however, considerably heavier than such speedboats. Their propeller has thick blades and is designed for heavy loads, whereas the supercavitating propellers of speedboats are shaped in an entirely different way. In the case of ships that are supposed to be ice-going, the Froude number, which represents the ratio of their speed to the length of the waterline, is lower than 0.5, whereas it is higher than 1.0 in the case of planing speedboats.

Methods are also known in which air is blown into the water around the hull of the ship. The blowing produces a vertical flow which lifts the ice off the face of the hull and, at the same time, directs ice off the propeller. In the systems, air is, however, not blown to the propeller, because this has been considered detrimental to the operation of the propeller. Nor is the supply of air controlled in accordance with the speed of rotation or resistance of the propeller.

The method in accordance with the present invention is characterized in that the method is used on an ice-going ship in order to reduce the increase in the resistance to rotation of the propeller and/or the lowering of the speed of rotation of the propeller, which are caused by the ice. The supply of gas can be increased when the resistance to rotation of the propeller, caused by the ice, increases. The arrangement in accordance with the invention is characterized in that the arrangement is fitted on an ice-going ship. According to the invention, the resistance to rotation of the propeller can be reduced efficiently in a very simple way, which can be carried out at a low cost. By passing gas to the propeller, it is possible to lower the water resistance of the propeller, e.g., by about 50 per cent. At the same time, the thrust by the propeller and the quantity of water flowing through the propeller are reduced, whereby a smaller quantity of ice, causing resistance in the propeller, is also carried to the propeller along with the water. In such a case, as a secondary advantage, reduction in the ice resistance may also be achieved.

When gas is passed to the propeller in accordance with the invention, it is important to have the major part of the face of the propeller blade at the suction side covered with gas. The gas bubble prevents contact of the suction face of the blade with water and ice and reduces the negative pressure, whereby the resistance of the propeller is reduced. At the initial stage of the controlling, when the resistance is being lowered and when the gas bubble is first being formed, a sufficient amount of gas must be passed to the propeller, at least 0.5%, possibly at least 1% of the quantity of water passing through the propeller. Even a larger amount of gas, 2%, may be necessary. After gas has been introduced into the propeller, it remains in contact with the blades, and the supply of gas can be reduced so that it equals the quantity of gas escaping from the propeller. At this stage, a suitable quantity of gas is perhaps about half the quantity that was required at the beginning, or even less.

The supply of gas to the propeller can be arranged so that it begins, e.g., when the power regulator of the drive engine of the ship is shifted beyond a certain limit when the power is being increased. The supply can also be controlled by means of a detector which measures the speed of rotation of the propeller and increases the supply when the speed of rotation becomes lower. The detector may also measure the torque of the propeller, in which case the supply of gas begins when the torque is increased. Detectors of other sorts, e.g. detectors observing the approach of ice, can be concerned. In order that the gas could be passed to the propeller rapidly and that its effect could also be stopped rapidly, the point of feed of gas must be as near the propeller as possible.

Gas may be supplied either to the main propeller or propellers of the ship only, or also to the steering propellers. In this connection, main propeller means all those propellers whose power is at least half the power of the largest propeller of the ship. The power of the steering propellers is lower than this.

Figure 2:
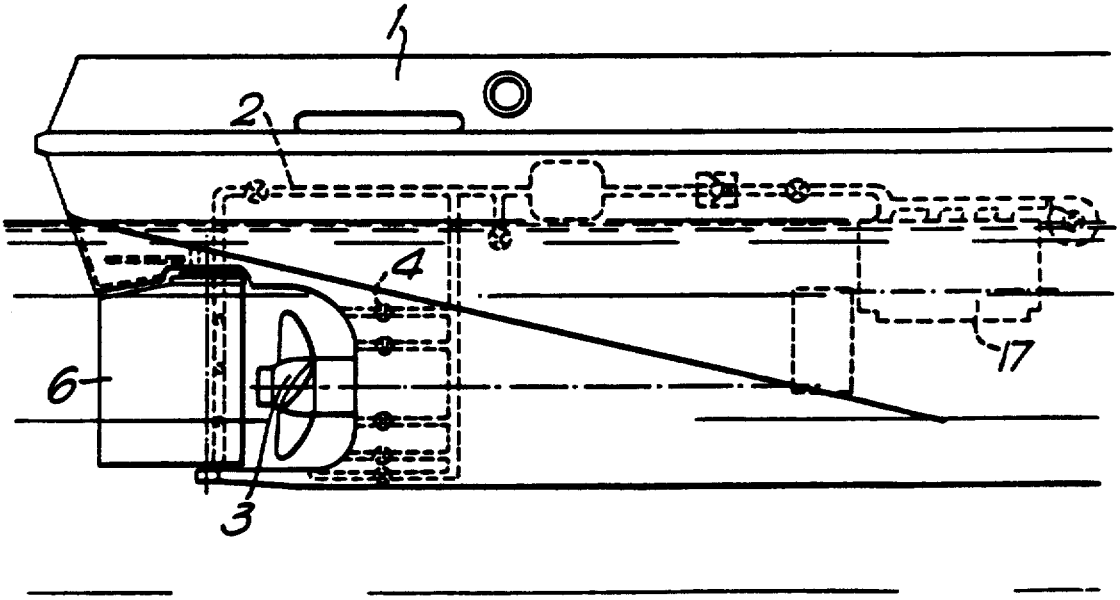
Figure 4:
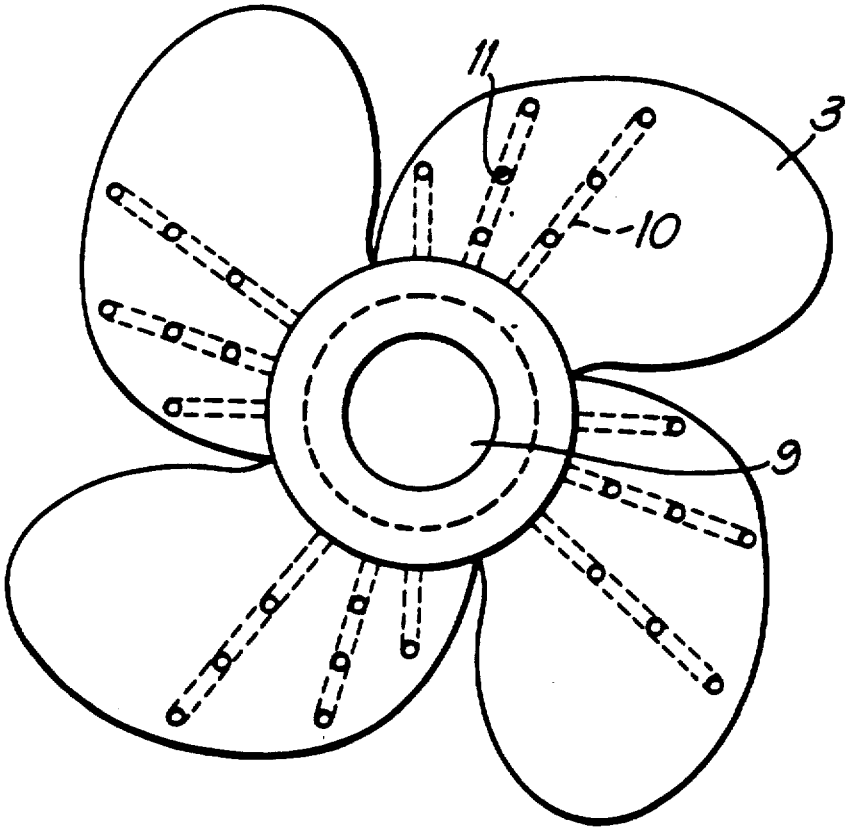
Figure 3:
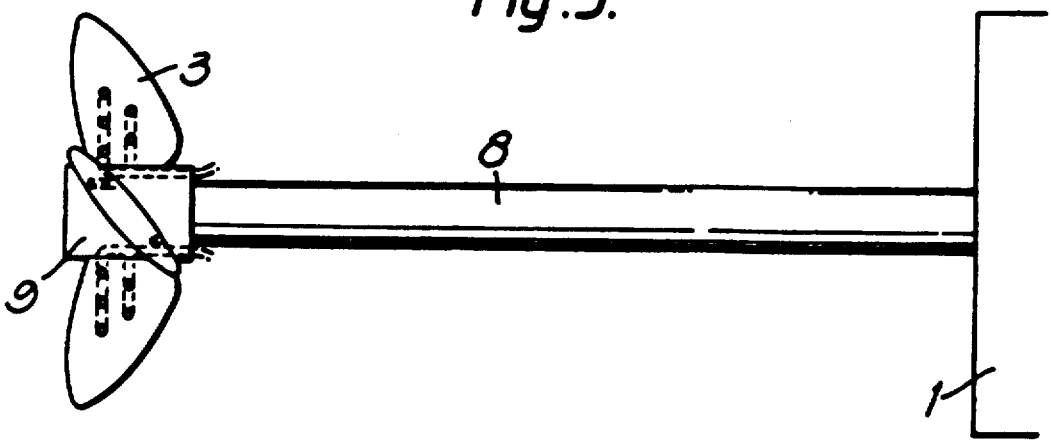
Figure 5:
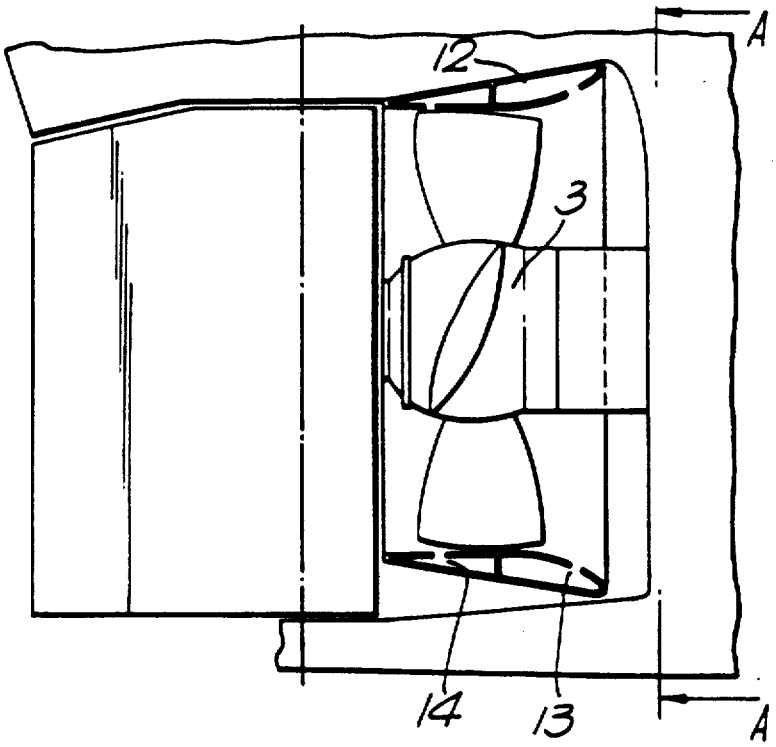
Figure 6:
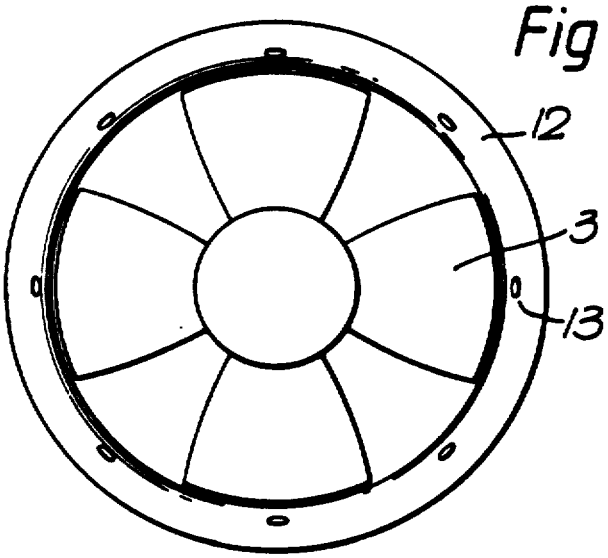
Figure 7:
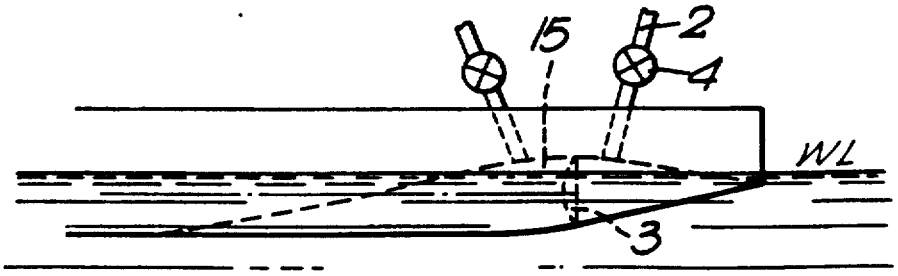

The invention and its details will be described more closely in the following with reference to the accompanying drawings, wherein FIG. 1 is a side view of a ship stern where the invention is applied, FIG. 2 is a side view of a ship stern where a second embodiment of the invention is used, FIG. 3 shows an embodiment of a propeller to be used on a ship in accordance with the invention, FIG. 4 shows the same propeller viewed from the front as a vertical section, FIG. 5 is a side view of a nozzle propeller to be used in a ship in accordance with the invention with the nozzle in section, FIG. 6 shows the same propeller as a front view and as a section at A - A, and FIG. 7 is a schematical side view of the stern of a ship provided with a tunnel stern, wherein the invention is applied.

In the embodiment of FIG. 1, a pipe system 2 is arranged in the stern part of the ship 1 hull so as to pass air to the front and to the rear of the propeller 3. The pipe system is provided with valves 4 for controlling the air quantity. The pipes that pass air to ahead of the propeller are opened in the rear face of the sternpost 5 of the ship and in the top face of the sole piece 5A as well as in the propeller. On backing, the pipes passing air to the rear side of the propeller are opened at the front edge of the rudder 6. For the supply of the air into the pipe system, the pipe system is provided with a fan 7 or with a compressor. The system may also be provided with a compressed-air tank 16. The propeller is located completely below the water level WL. When the ship runs forwards and the resistance to rotation of the propeller must be lowered because of ice, air is passed to ahead of the propeller, to its suction side.

FIG. 2 illustrates an embodiment in which the air is received from the supercharger of the engine 17. This is advantageous in view of the operation of the engine. When the operating power of the engine increases, the supercharger, viz., attempts to give the engine more supercharging air, which cannot be used by the engine as the speed of rotation is going down.

FIGS. 3 and 4 show a solution for the passage of air. The air pipe passes through the propeller 3 shaft 8 into the propeller hub 9, from which bores 10 pass into each blade. From each bore, openings 11 are opened into the face of the blade. FIG. 1 also shows the arrangement by which the compressed air source 16 provides the gas through a check valve to the propeller. The arrangement of FIG. 1 also includes a controller C for controlling the degree of opening of the check valves so as to supply the gas to the propeller. The controller C receives input signals from detector inputs 20, 21 and 22. As an example, the detector 20 could control the supply of gas by detecting ice approaching the propeller. Detector 21 could control the supply of gas by providing a detected input relating to the torque of the propeller shaft while detector 22 could determine a measure of the detected speed of rotation of the propeller shaft.

FIGS. 5 and 6 show an application of the invention in connection with a nozzle propeller. The propeller 3 is surrounded by a nozzle 12 fixed to the hull 1 of the ship. Air is passed into the nozzle, and openings 13 are opened from it to ahead of the propeller, and openings 14 to the rear of the propeller.

FIG. 7 shows an application of the invention to a ship provided with a tunnel stern, which is suitable for sailing in shallow waters. At the stern of the ship, the bottom of the ship is curved upwards above the propeller so that a closed space 15 is formed facing the propeller above the waterline WL surrounding the ship, the propeller 3 extending partly into the said closed space. When air is passed into this space through a pipe system 2, the propeller blades also carry air along with them to underneath the water level. The air can be taken straight from the outdoor air, for the negative pressure prevailing in the closed space sucks air into the space through the pipe system 2 without an external pressure source when the valves 4 are open.

The invention is not confined to the above embodiments only, but it may show variation in many ways within the scope of the patent claims. In stead of air, it is also possible to pas some other gas to the propeller, e.g. exhaust gas from the drive engine of the ship. In stead of openings, it is also possible to use appropriately shaped grooves in order to pass the gas to the desired location. The gas can also be passed to the propeller through particular projections fixed to the hull of the ship, which projections may, at the same time, guide ice off the propeller or water to the propeller. If the ship is provided with a steering propeller mounted on a turnable support, gas supply points may be placed on this support.

The control of the gas supply may take place automatically or manually. The supply of gas may take place as such or as a mixture of gas and liquid. The gas or the mixture of gas and liquid may also contain particles of solid material. Bubbles of gas may also be formed by to the propeller or to its proximity feeding a chemical that produces formation of a gas in water, or by physical means, e.g. by decomposing water so that an electric current is passed into water.

What is claimed is:

1. A method for reducing resistance to rotation of a propeller of an ice-going ship when the ship is moving through ice-covered water comprising, supplying gas to a suction side of the propeller of the ice-going ship in order to reduce an increase of resistance to rotation of the propeller, said increase of resistance resulting from a lowering of running speed of the ship when the ship is in ice and from ice entering the propeller including controlling supply of the gas dependent upon changes in the resistance of rotation including controlling the supply of the gas by a detector measuring speed of rotation of a propeller shaft.

2. A method for reducing resistance to rotation of a propeller of an ice-going ship when the ship is moving through ice-covered water comprising, supplying gas to a suction side of the propeller of the ice-going ship in order to reduce an increase of resistance to rotation of the propeller, said increase of resistance resulting from a lowering of running speed of the ship when the ship is in ice and from ice entering the propeller including controlling supply of the gas dependent upon changes in the resistance of rotation including controlling the supply of the gas by detecting torque of a propeller shaft.

3. A method for reducing resistance to rotation of a propeller of an ice-going ship when the ship is moving through ice-covered water comprising, supplying gas to a suction side of the propeller of the ice-going ship in order to reduce an increase of resistance to rotation of the propeller, said increase of resistance resulting from a lowering of running speed of the ship when the ship is in ice and from ice entering the propeller including controlling supply of the gas dependent upon changes in the resistance of rotation including controlling the supply of the gas by detecting ice approaching the propeller.

* * * * *

UNITED STATES PATENT AND TRADEMARK OFFICE

CERTIFICATE OF CORRECTION

PATENT NO. : 5,074,813

DATED : December 24, 1991

INVENTOR(S) : Antti K.H. Jarvi et al.

It is certified that error appears in the above-identified patent and that said Letters Patent is hereby corrected as shown below:

On the title page: should read:

[73] Assignee: Aquamaster-Rauma Oy, Finland

Signed and Sealed this

Twelfth Day of October, 1993

*Attest:*

*Attesting Officer*

BRUCE LEHMAN

*Commissioner of Patents and Trademarks*